US006428412B1

(12) United States Patent
Anderson et al.

(10) Patent No.: US 6,428,412 B1
(45) Date of Patent: Aug. 6, 2002

(54) GAMING MACHINE WITH INTERLINKED ARRANGEMENTS OF PUZZLE ELEMENTS

(75) Inventors: Peter Anderson, Chicago; Taron A. Bell, Round Lake; Michael P. Casey, Chicago; Joel R. Jaffe, Evanston; Laura R. Ledesma; Michael W. Mastropietro, both of Chicago; Eric Michael Pryzby, Skokie; Shawn A. Smith, Westmont, all of IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/663,095

(22) Filed: Sep. 15, 2000

(51) Int. Cl.[7] ..... A63F 9/24
(52) U.S. Cl. ..... 463/9; 463/16; 463/20
(58) Field of Search ..... 463/9, 10, 11, 463/12, 13, 15, 16, 17, 18, 19, 20, 21, 22, 25, 27; 273/153 R, 236, 272, 292, 139, 299, 461

(56) References Cited

U.S. PATENT DOCUMENTS 4,961,579 A * 10/1990 Thompson et al. ..... 273/153 R
5,788,573 A 8/1998 Baerlocher et al.
5,833,537 A * 11/1998 Barrie ..... 463/21
5,860,653 A * 1/1999 Jacobs ..... 273/272
5,919,088 A * 7/1999 Weiss ..... 463/9
5,947,820 A * 9/1999 Morro et al. ..... 463/9
6,095,921 A * 8/2000 Walker et al. ..... 463/20
6,231,442 B1 * 5/2001 Mayeroff ..... 463/20
6,241,607 B1 * 6/2001 Payne et al. ..... 463/20
6,264,198 B1 * 7/2001 Stamper ..... 273/157 R

* cited by examiner

*Primary Examiner*—Joe H. Cheng
*Assistant Examiner*—K. Nguyen
(74) *Attorney, Agent, or Firm*—Jenkens & Gilchrist

(57) ABSTRACT

A gaming machine is controlled by a processor in response to a wager and comprises a puzzle feature optionally triggered by a start-feature outcome of a basic game. The puzzle feature includes a plurality of arrangements of randomly-selected puzzle elements for generating respective payouts. At least one of the puzzle elements of each arrangement being shared by another one of the arrangements and contributing to the payouts generated by the respective arrangements that share the one of the puzzle elements. The puzzle elements may, for example, be letters, symbols, pictures, shaped puzzle pieces, or playing cards.

21 Claims, 16 Drawing Sheets

GAMING MACHINE WITH INTERLINKED ARRANGEMENTS OF PUZZLE ELEMENTS

FIELD OF THE INVENTION

The present invention relates generally to gaming machines and, more particularly, to a gaming machine including a puzzle feature with interlinked bonus elements.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features for bonus games to satisfy the demands of players and operators. Preferably, such new bonus game features will maintain, or even further enhance, the level of player excitement offered by bonus games heretofore known in the art. The present invention is directed to satisfying these needs.

SUMMARY OF THE INVENTION

In accordance with the present invention, a gaming machine is controlled by a processor in response to a wager and comprises a puzzle feature optionally triggered by a start-feature outcome of a basic game. The puzzle feature includes a plurality of arrangements of randomly-selected puzzle elements for generating respective payouts. At least one of the puzzle elements of each arrangement being shared by another one of the arrangements and contributing to the payouts generated by the respective arrangements that share the one of the puzzle elements. The puzzle elements may, for example, be letters, symbols, pictures, shaped puzzle pieces, or playing cards.

BRIEF DESCRIPTION OF THE DRAWINGS

The foregoing and other advantages of the invention will become apparent upon reading the following detailed description and upon reference to the drawings in which.

Figure 1:
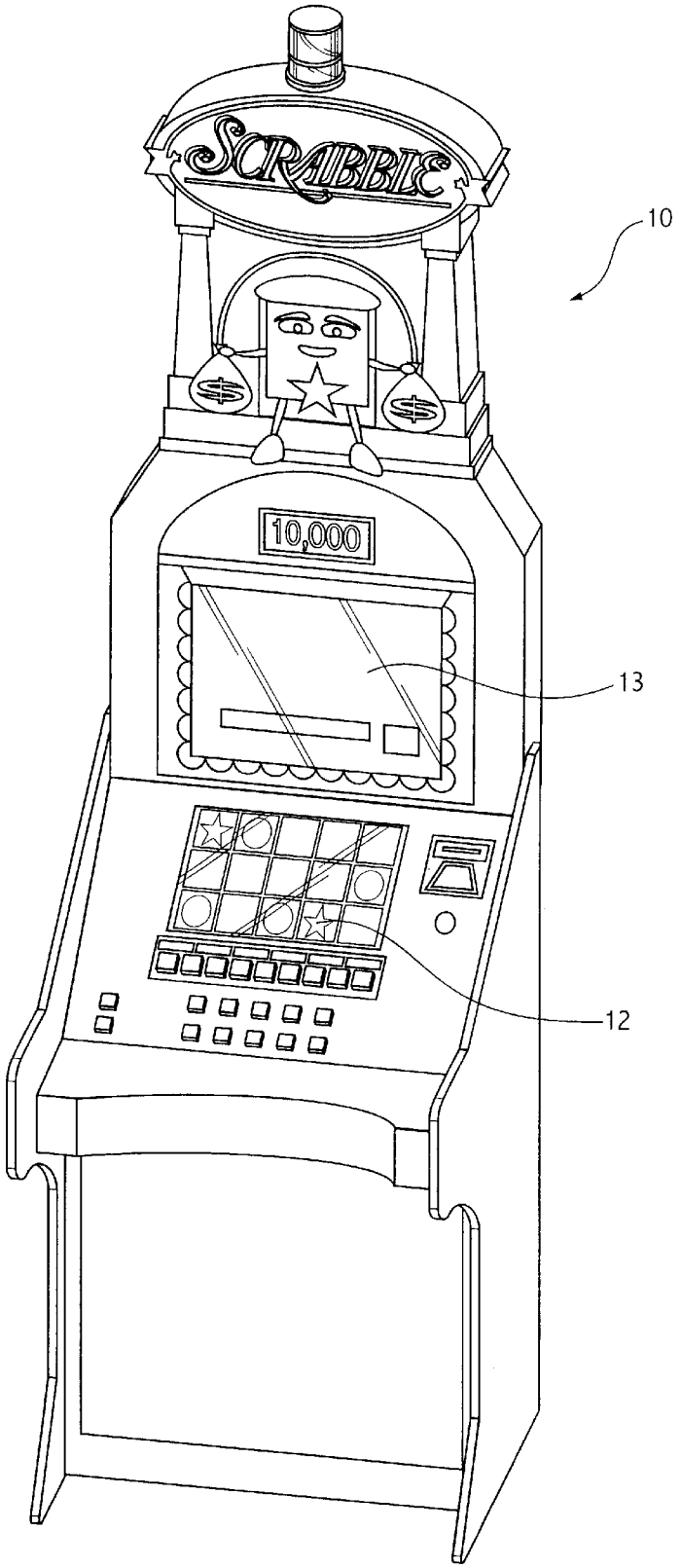
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a gaming machine 10 that may be used to implement a bonus game according to the present invention. The gaming machine 10 includes lower and upper visual displays 12 and 13 preferably in the form of a dot matrix, CRT, LED, LCD, electro-luminescent, or other type of video display known in the art. The lower display 12 preferably includes a touch screen overlaying the monitor. In the illustrated embodiment, the gaming machine 10 is an "upright" version in which both the lower and upper displays 12 and 13 are oriented vertically relative to the player. Alternatively, the gaming machine may be a "slant-top" version in which the lower display 12 is slanted at about a thirty-degree angle toward the player of the gaming machine 10 and the upper display 13 is oriented vertically relative to the player.

In one embodiment, the gaming machine 10 is operable to play a game of chance entitled Stop the Music Scrabble having a theme based on the popular crossword game SCRABBLE® by the Milton Bradley Company. The game features a basic slot game with five simulated spinning reels and a multiple bonus games triggered by different outcomes in the basic game. It will be appreciated, however, that the gaming machine 10 may be implemented with themes other than SCRABBLE®.

Figure 2:
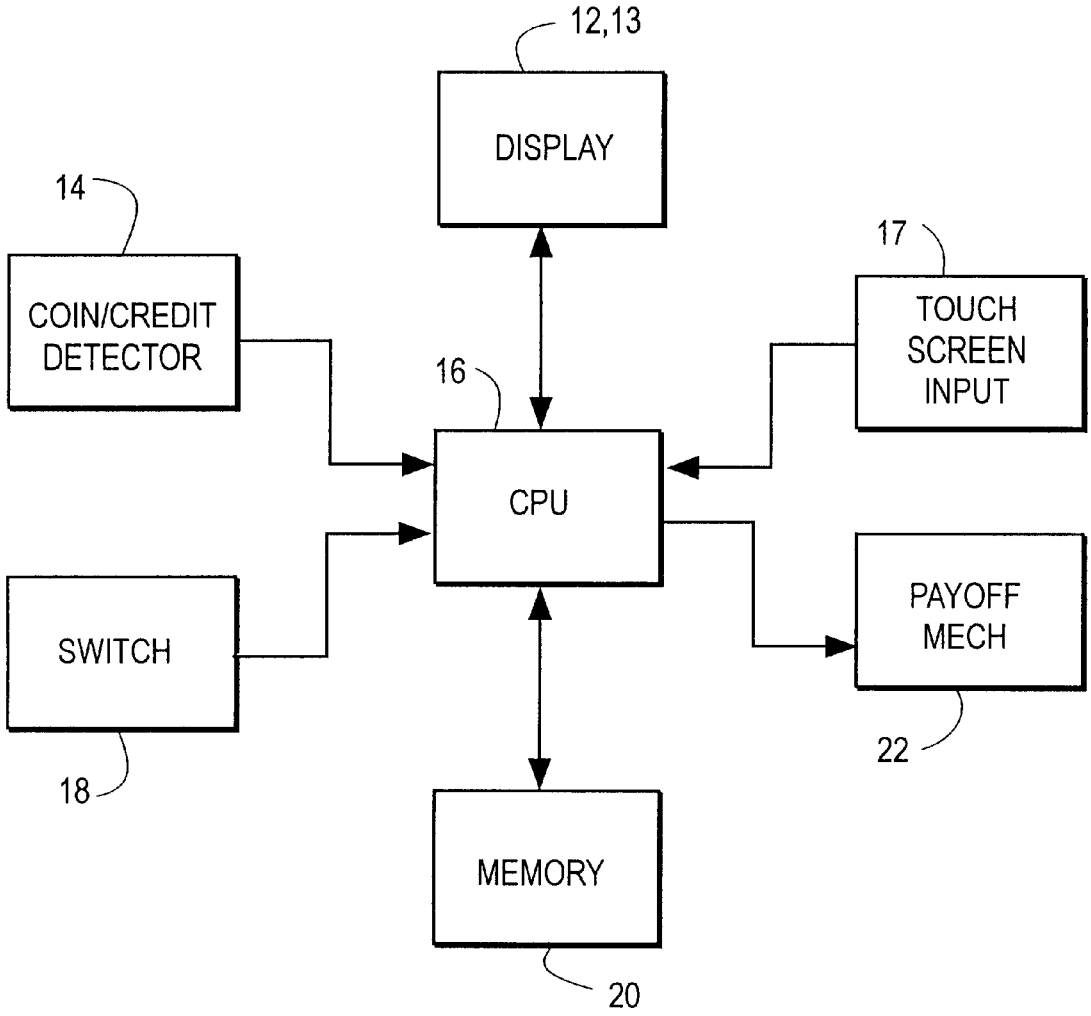
FIG. 2 is a block diagram of a control system suitable for operating the gaming machine.

FIG. 2 is a block diagram of a control system suitable for operating the gaming machine 10. Coin/credit detector 14 signals a central processing unit ("CPU") 16 when a player has inserted a number of coins or played a number of credits. Then, the CPU 16 operates to execute a game program that causes the lower display 12 to display the basic game that includes simulated symbol-bearing reels. The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome, and then stop the reels to display symbols corresponding to the pre-selected game outcome. In one embodiment, certain of the basic game outcomes cause the CPU 16 to enter an associated bonus mode causing one or both of the displays 12 and 13 to show an associated bonus game.

A system memory 20 stores control software, operational instructions and data associated with the gaming machine 10. In one embodiment, the memory 20 comprises a separate read-only memory (ROM) and battery-backed random-access memory (RAM). However, it will be appreciated that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which might occur in the basic game or bonus games. The payoff amounts corresponding to certain combinations of symbols in the basic game is predetermined according to a pay table stored in system memory 20. The payoff amounts corresponding to certain outcomes of the bonus games are also stored in system memory 20.

Figure 3:
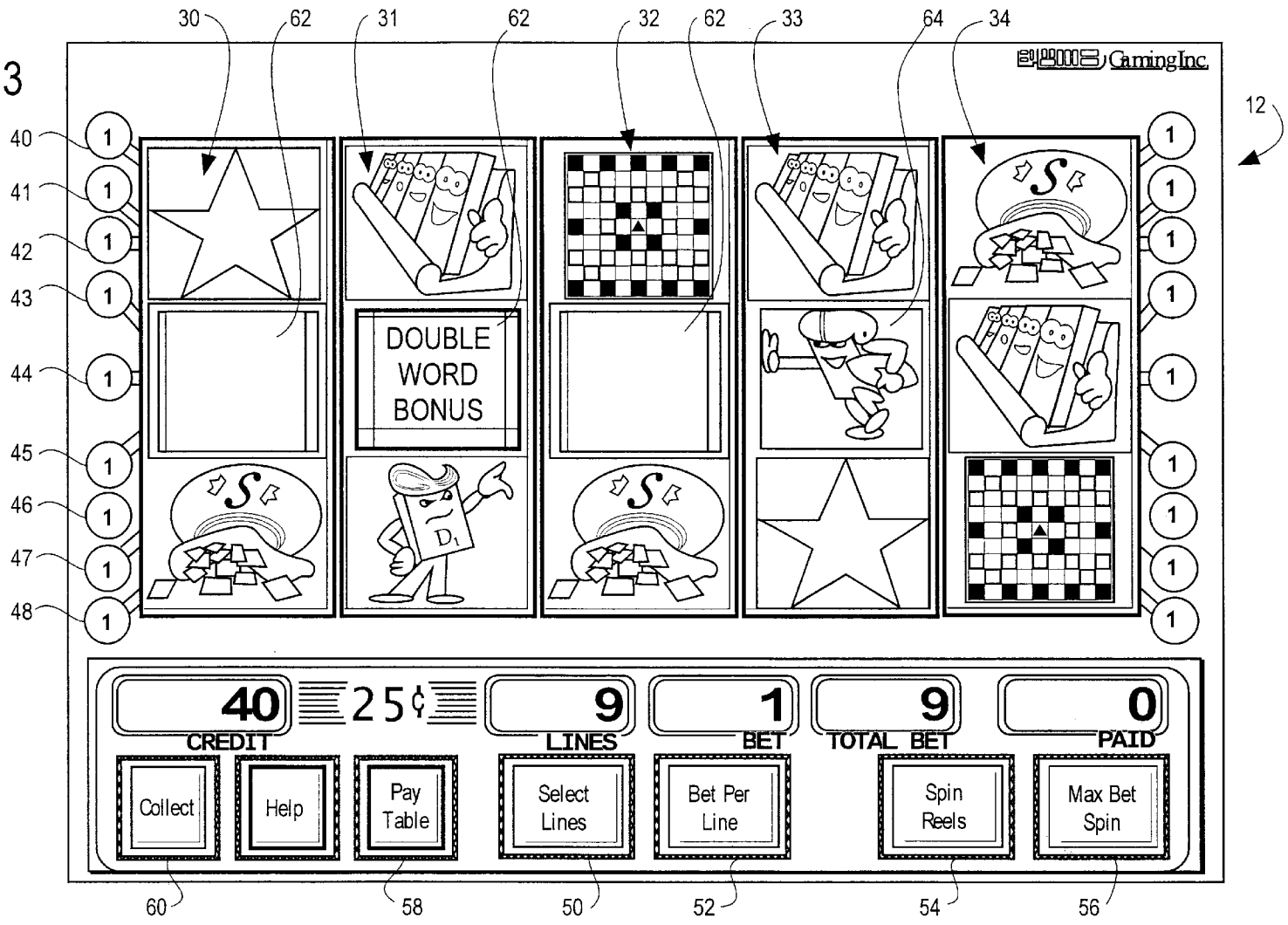
FIG. 3 is a display screen capture showing a start-bonus outcome on the gaming machine's simulated slot reels for triggering a "Word Reveal Picture Pay" bonus.

As shown in FIG. 3, the basic game is implemented on the lower display 12 on five video simulated spinning reels 30–34 (hereinafter "reels") with nine pay lines 40–48. Each of the pay lines 40–48 extends through one symbol on each of the five reels 30–34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the lower video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30–34 to stop at the appropriate stop position. Video symbols are displayed on the reels 30–34 to graphically illustrate the reel stop positions and indicate whether the stop positions of the reels represent a winning game outcome. Some of the video symbols disposed in the reels 30–34 are illustrated in FIG. 3 and include a Scrabble Logo, Scrabble Board, Scrabble Dictionary, Scrabble Letter Bag, Letter Racks, Non-Character Scrabble Tile, and Character Scrabble Tile. The Non-Character Scrabble Tile symbols include generic Scrabble Tile symbols, a Double Word Tile symbol (Wild x2), and a Triple Word Tile symbol (Wild x3).

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. A winning combination, for example, could be three or more Scrabble Letter Bag symbols along an active pay line, where the award is greater as the number of Scrabble Letter Bag symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 60. In a preferred implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes are a plurality of start-bonus outcomes for starting play of their associated bonus games. A start-bonus outcome may be defined in any number of ways. For example, a start-bonus outcome occurs when a special start-bonus symbol or a special combination of symbols appears on one or more of the reels 30–34. The start-bonus outcome may require the combination of symbols to appear along an active pay line, or may alternatively require that the combination of symbols appear anywhere on the display regardless of whether the symbols are along an active pay line. The appearance of a start-bonus outcome causes the CPU to shift operation from the basic game to the associated bonus game.

Referring to FIG. 3, three Non-Character Scrabble Tile symbols 62 aligned horizontally along the respective reels 30, 31, and 32 trigger a "Word Reveal Picture Pay" bonus. In this bonus, the three Non-Character Scrabble Tile symbols animate to reveal a three-letter word randomly selected by the CPU from a list of three-letter words. The awarded bonus is equal to the sum of the values on each letter of the word multiplied by the player's total bet. The letter values range from one to ten. If one of the three Non-Character Scrabble Tile symbols 62 is a Double Word Tile symbol like on reel 31 in FIG. 3, the bonus is multiplied by two. If one of the three Non-Character Scrabble Tile symbols 62 is a Triple Word Tile symbol, the bonus is multiplied by three. The Double Word Tile symbol and the Triple Word Tile symbol are cumulative such that the presence of both symbols in the triggering combination causes the bonus to be multiplied by six.

If a Character Scrabble Tile symbol 64 lands on the reel 33 in horizontal alignment with the three Non-Character Scrabble Tile symbols 62 along the respective reels 30, 31, and 32, the Character Scrabble Tile symbol 64 animates to lengthen the word to four letters. Such a Character Scrabble Tile symbol 64 is depicted on reel 33 in FIG. 3. The CPU randomly selects the four-letter word from a list of four-letter words. If Character Scrabble Tile symbols 64 land on both the reels 33 and 34 in horizontal alignment with the three Non-Character Scrabble Tile symbols 62 along the respective reels 30, 31, and 32, the Character Scrabble Tile symbols 64 animate to lengthen the word to five letters. The CPU randomly selects the five-letter word from a list of five-letter words.

Figure 4:
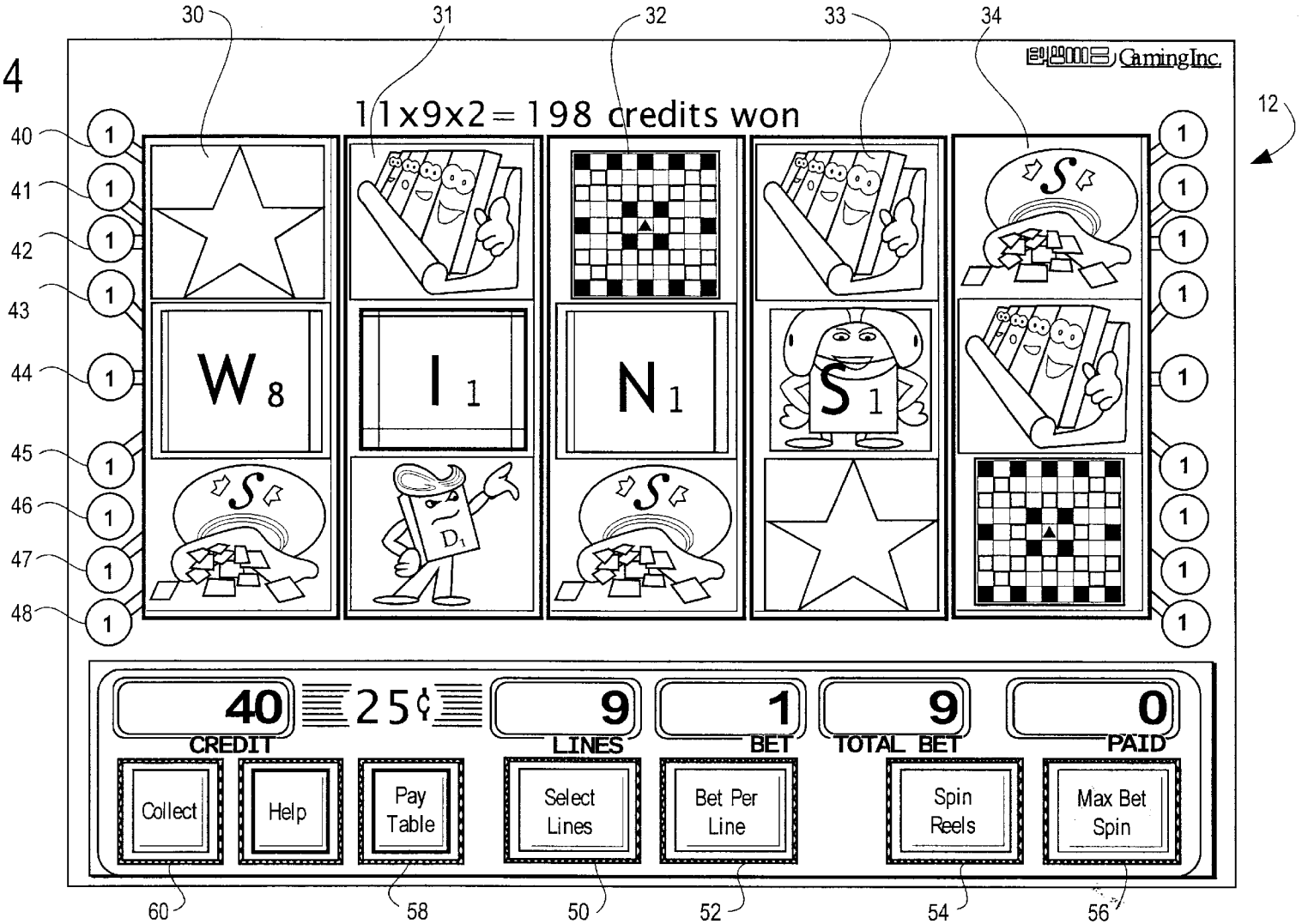
FIG. 4 is a display screen capture associated with the "Word Reveal Picture Pay" bonus.

In the illustrated example, the "Word Reveal Picture Pay" bonus is triggered by three Non-Character Scrabble Tile symbols 62 along the respective reels 30, 31, and 32 and a Character Scrabble Tile symbol 64 on the reel 33. These symbols animate to spell the word "WINS" depicted in FIG. 4. The word "WINS" generates a bonus of 198 credits $=(8+1+1+1)\times 9\times 2$, where $(8+1+1+1)$ is the sum values on each letter, 9 is the player's total bet, and 2 is due to the Double Word Tile symbol on reel 31.

Figure 5:
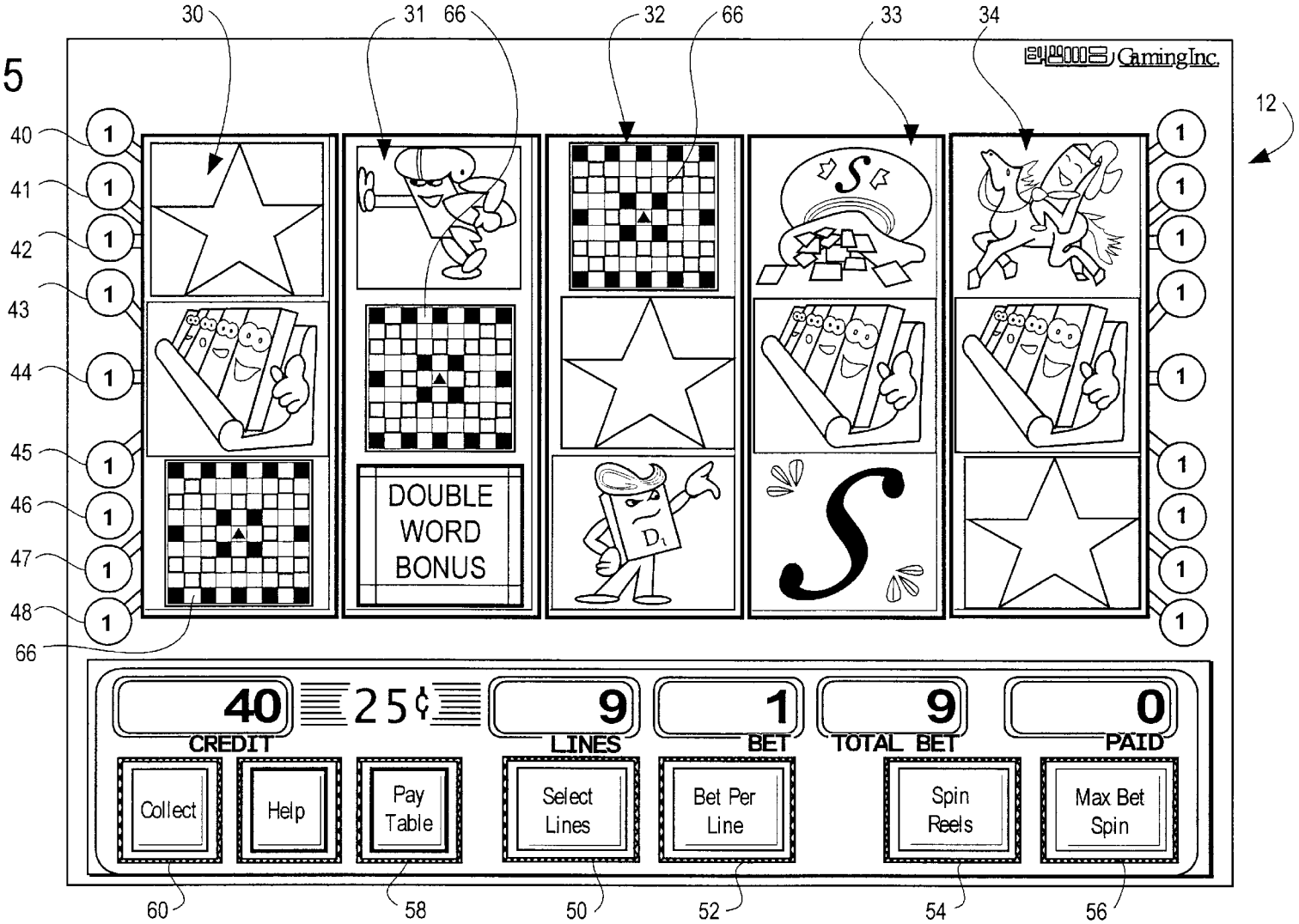
FIG. 5 is a display screen capture showing a start-bonus outcome on the gaming machine's simulated slot reels for triggering a "Scrabble" bonus feature.
Figure 6:
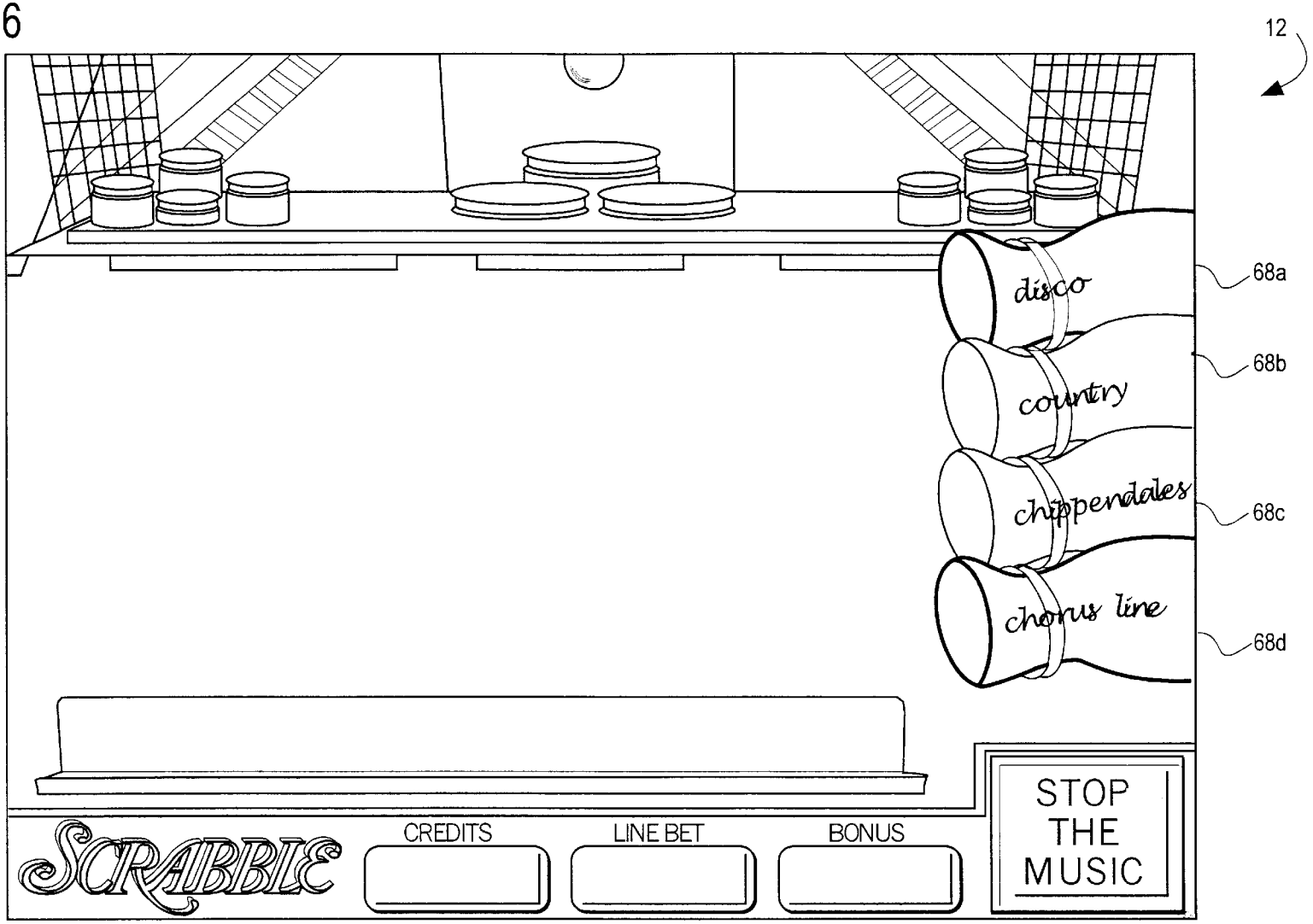
FIGS. 6 through 16 are display screen captures on a lower display (FIGS. 6 through 11 and 14 through 16) and an upper display (FIGS. 12 and 13) associated with the "Scrabble" bonus feature.

Referring to FIG. 5, three or more Scrabble Board symbols 66 along an active pay line trigger a "Scrabble" bonus feature. The "Scrabble" bonus feature is played on both the lower and upper displays 12 and 13. Referring to FIG. 6, the lower display 12 initially depicts a plurality of letter bags 68*a*, 68*b*, 68*c*, and 68*d* having respective themes. The themes, for example, may include disco, country, Chippendales, and chorus line. By a verbal or written instructions, the machine prompts the player to select one of the themed letter bags 68*a–d* in order to see the letters of a first word. The player then selects one of the bags. If the lower display 12 is outfitted with a touch screen, this selection can be made by touching the display 12 at a location of the selected bag.

Figure 7:
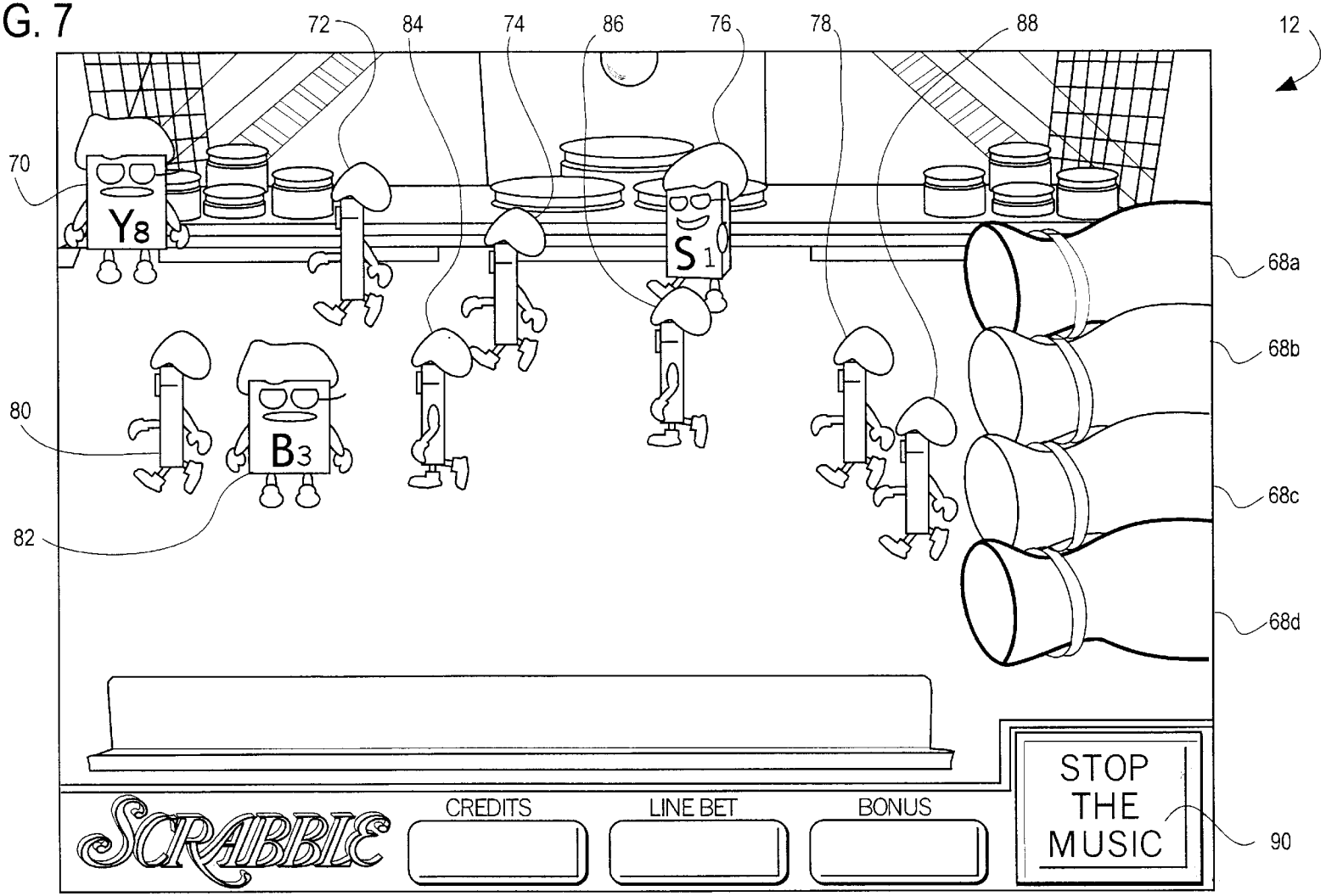
Figure 8:
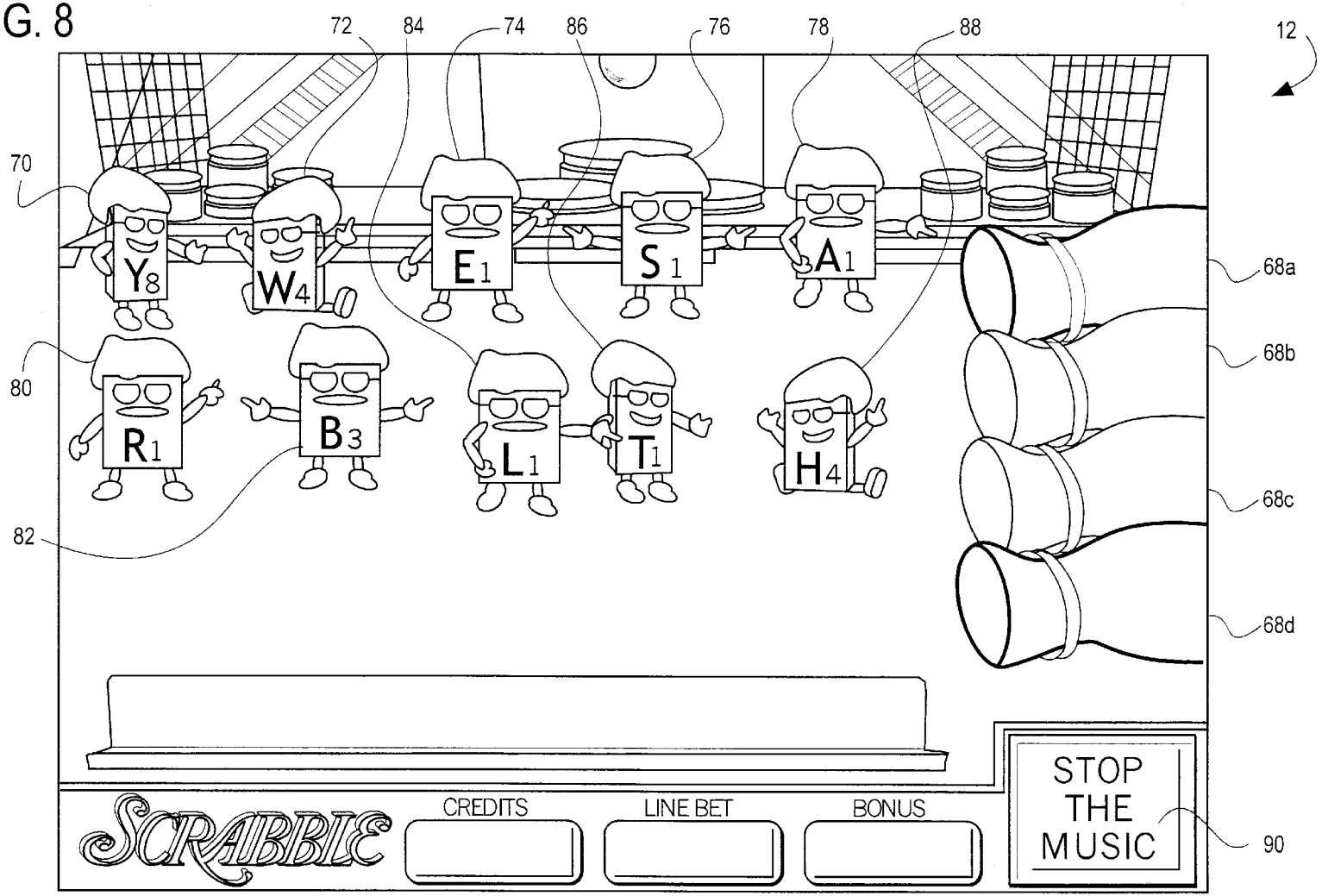

Referring to FIGS. 7 and 8, in response to the player's selection of one of the bags 68*a–d* (e.g., bag 68*c* in FIG. 7), tiles 70, 72, 74, 76, 78, 80, 82, 84, 86, and 88 dance out of the selected bag and toward a center of the display 12. The tiles dance and are "dressed" according to the theme of the selected bag. Also, music plays according to the theme. The tiles continue to dance until the player presses a "Stop the Music" button 90, which may be directly on the display 12 if it is outfitted with a touch screen.

Figure 9:
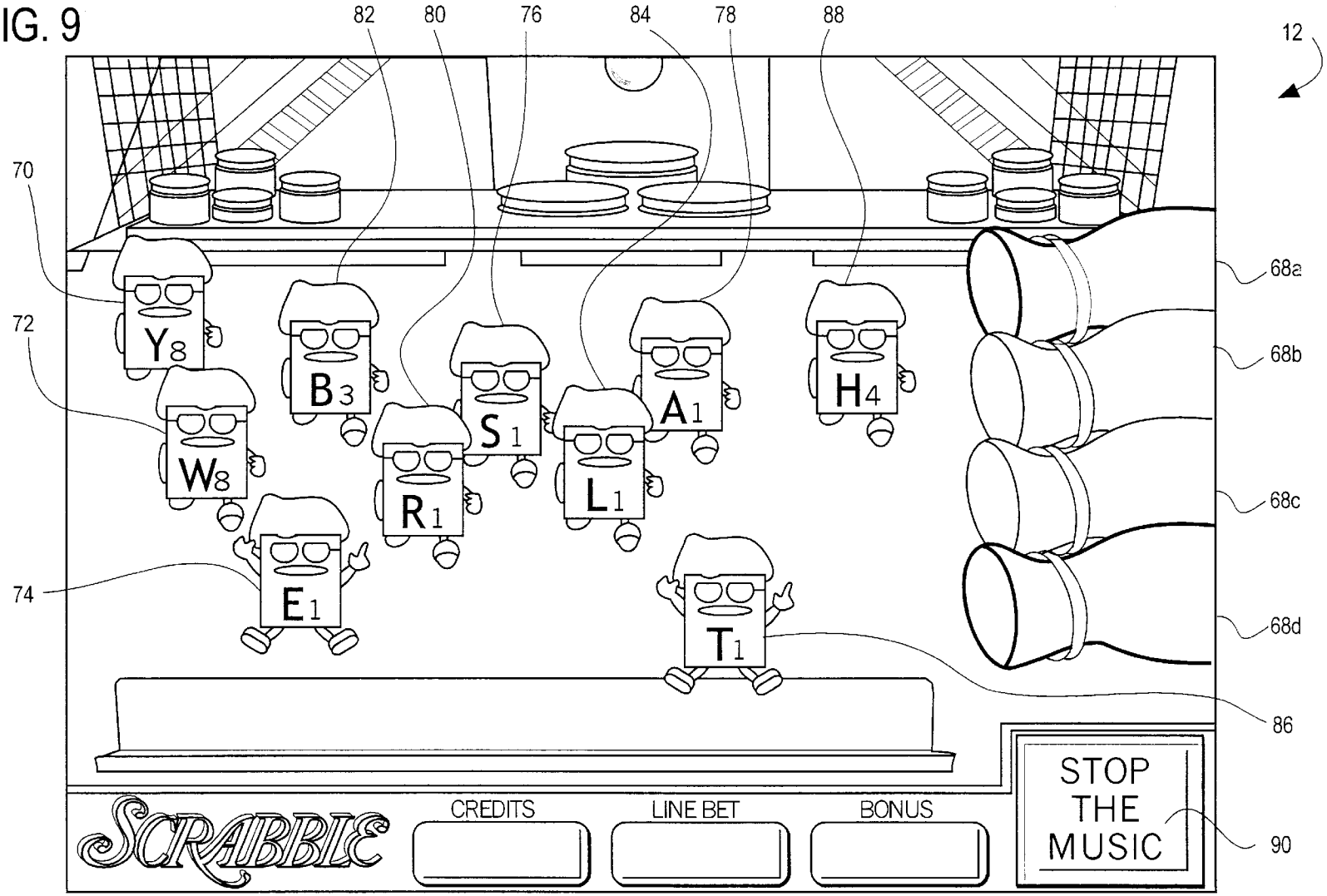
Figure 10:
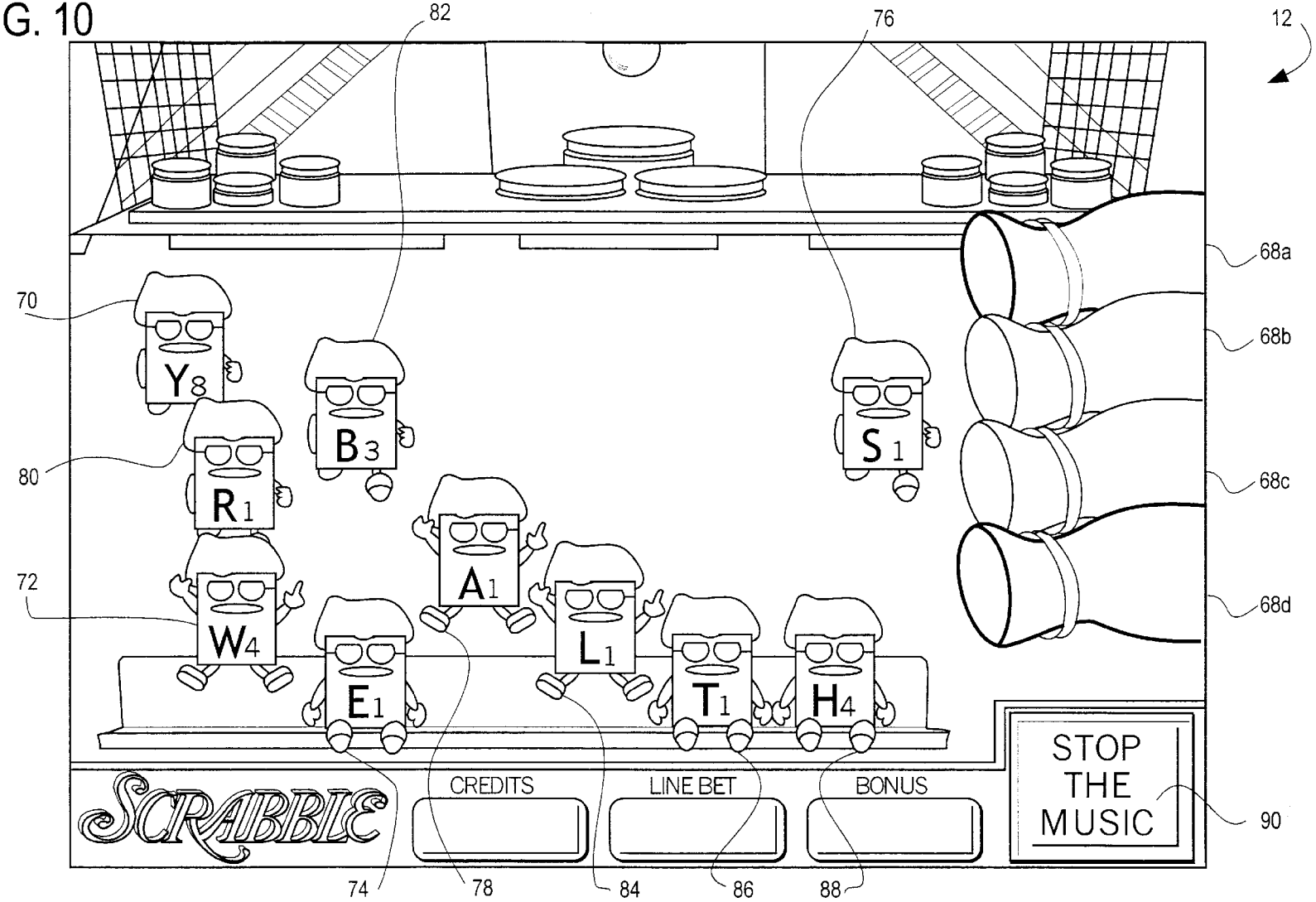
Figure 11:
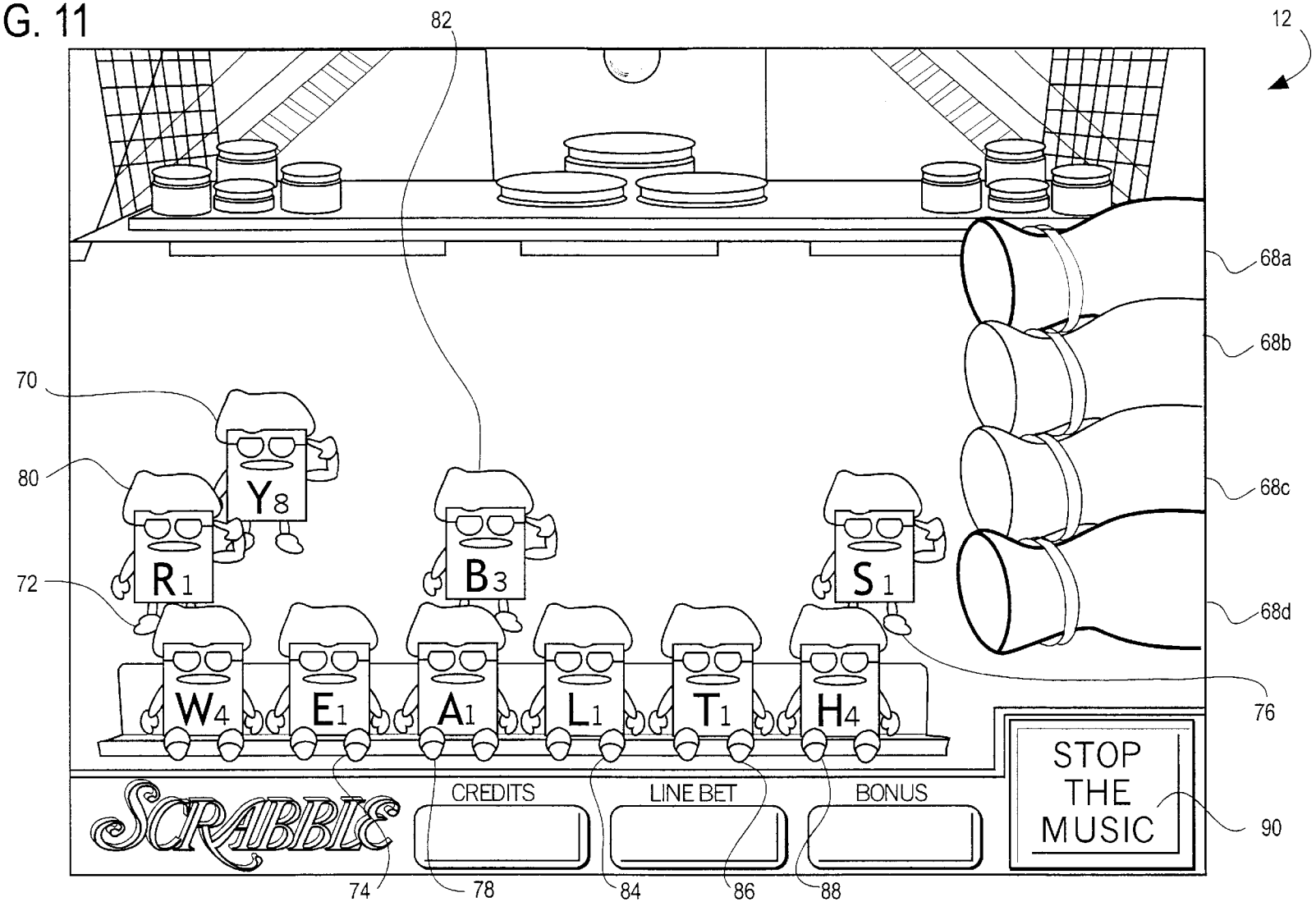

Referring to FIGS. 9, 10, and 11, in response to pressing the "Stop the Music" button 90, the music stops and the tiles race toward a letter rack 92. Not all of the tiles make it to the rack 92, but the tiles that do make it form a word. In FIG. 11, for example, the tiles 72, 74, 78, 84, 86, and 88 make it to the rack 92 and form the word "WEALTH." Sometimes after the tiles form a word, a lower value tile may be "tossed out" of the rack 92 by a higher value tile to form a higher value word.

Figure 12:
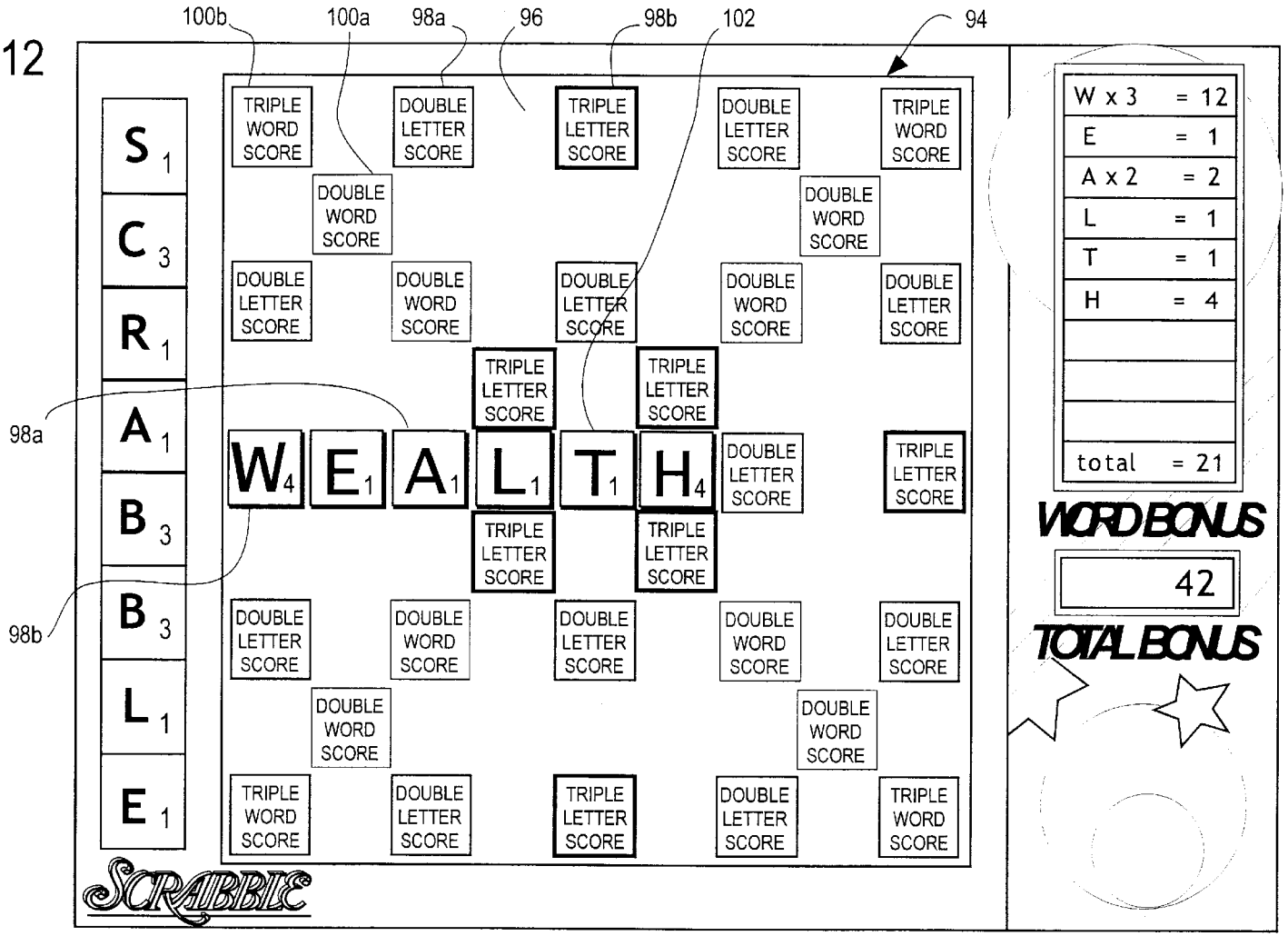

Referring to FIG. 12, while the animation is taking place on the lower display 12, the upper display 13 depicts a SCRABBLE® puzzle board 94. Consistent with the crossword game SCRABBLE®, interlinking words are formed in crossword fashion on the puzzle board 94 using letter tiles of different values. The value of each letter tile is preferably indicated by a numerical subscript following the letter written on the tile. The puzzle board 94 contains a 9×9 array of squares including regular squares 96 and premium squares 98*a–b*, 100*a–b*, and 102. The premium squares include premium letter squares 98*a–b* that double or triple the bonus value of a letter tile placed on it, and premium word squares 100*a–b* that double or triple the bonus value of a word having one of its letter tiles placed on a premium word square. If a word covers more than one premium square, premiums resulting from premium letter squares, if any, are counted toward the bonus value of the word before doubling or tripling the bonus value of the word due to a premium word square. Also, if a word covers more than one premium word square, the multipliers associated with the premium word squares are multiplied together. For example, if a word covers two "double" premium word squares, the bonus value of the word is doubled and then re-doubled. If a word covers two "triple" premium word squares, the bonus value of the word is tripled and then re-tripled. The center star square 102 serves as a premium word square that doubles the bonus value of the first word placed on the board 94. The maximum number of letters in a word is nine, and an additional "Bingo" bonus is awarded whenever all the dancing letter tiles get onto the rack and form a word having seven or more letters.

Because the gaming machine plays a game of chance, the player has no control over what words to create from the dancing tiles and where to place these words on the puzzle board 94. Rather, such determinations are made by the CPU in random fashion. For example, at the beginning of the "Scrabble" bonus feature, the CPU randomly selects a puzzle from a list of possible puzzles and assigns the first word for that puzzle to each of the themed letter bags 68*a–d* (see FIG. 6). Therefore, although the player may perceive that his or her selection of one of the themed bags 68*a–d* determines which puzzle is selected, the same puzzle is randomly selected by the CPU regardless of which bag is selected by the player. In other words, the themed bags 68*a–d* point to the same puzzle, not different puzzles.

Newly formed words on the rack 92 depicted in the lower display 12 are added by the CPU to the puzzle board 94 depicted in the upper display 13. The CPU determines what word should be formed from the available letter tiles and where the newly formed word should be added to the puzzle board. The first word is always placed vertically or horizontally on the board 94 with one of its letter tiles on the center star square 102. In FIG. 12, for example, the first word "WEALTH" was placed horizontally on the board 94 with the letter tile $T_1$ on the center star square 102. The bonus value of the word "WEALTH" is calculated to be 21 as follows:

| Letter | Letter Value | Premium Letter Square? | Bonus Value |
|---|---|---|---|
| W | 4 | x 3 | 12 |
| E | 1 | — | 1 |
| A | 1 | x 2 | 2 |
| L | 1 | — | 1 |
| T | 1 | — | 1 |
| H | 4 | — | 4 |
| Total | | | 21 |

The word bonus, however, is doubled to generate a total bonus of 42 because the word "WEALTH" occupies the center star square 102, which serves as a "double" premium word square.

Figure 13:
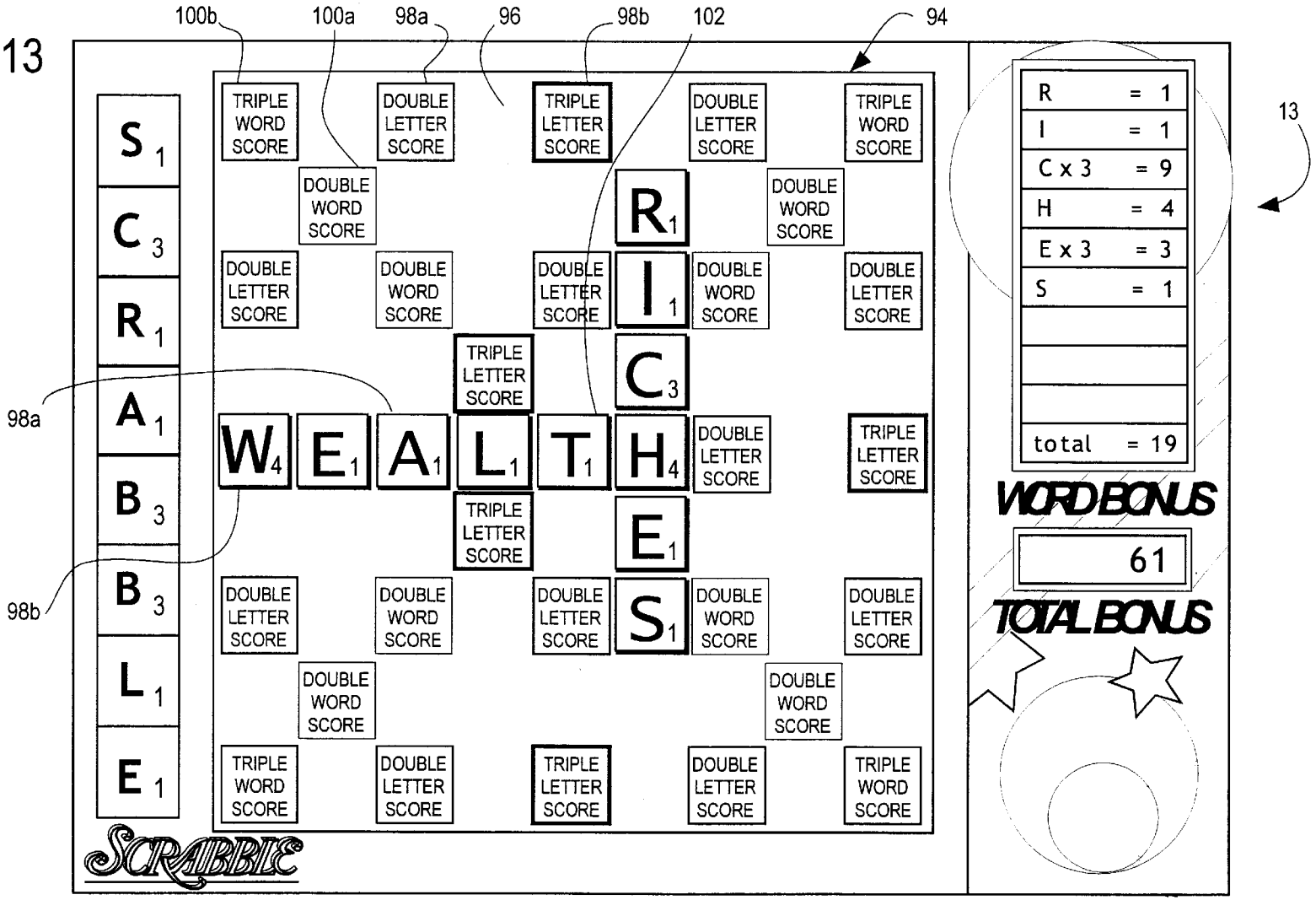

After the first word is placed on the puzzle board, the themed letter bags 68*a–d* and letter tiles (both those on the rack and the unused tiles) disappear from the lower display 12 and are replaced with four bags of different colors but having the same theme. The machine once again prompts the player to select one of the four letter bags in order to see the letters of a second word. The letters dance out of the selected bag and form the second word on the rack in the manner discussed above in connection with FIGS. 7 through 11. The second word is then placed on the puzzle board such that it interlinks, i.e., has a common letter tile, with the first word. If, for example, the second word is "RICHES," this word may be placed on the puzzle board 94 as shown in FIG. 13. As illustrated, the letter tile $H_4$ is common to both the first word "WEALTH" and the second word "RICHES." The bonus value of the word "RICHES" is calculated to be 19 as follows:

| Letter | Letter Value | Premium Letter Square? | Bonus Value |
|---|---|---|---|
| R | 1 | — | 1 |
| I | 1 | — | 1 |
| C | 3 | x 3 | 9 |
| H | 4 | — | 4 |

-continued

| Letter | Letter Value | Premium Letter Square? | Bonus Value |
|---|---|---|---|
| E | 1 | x 3 | 3 |
| S | 1 | — | 1 |
| Total | | | 19 |

This word bonus of 19 for "RICHES" is added to the previous doubled word bonus of 42 for "WEALTH" to increase the total bonus for the "Scrabble" bonus feature to 61. Because the letter tile $H_4$ is common to both "WEALTH" and "RICHES," this tile contributes to the bonuses generated by these respective words.

Figure 14:
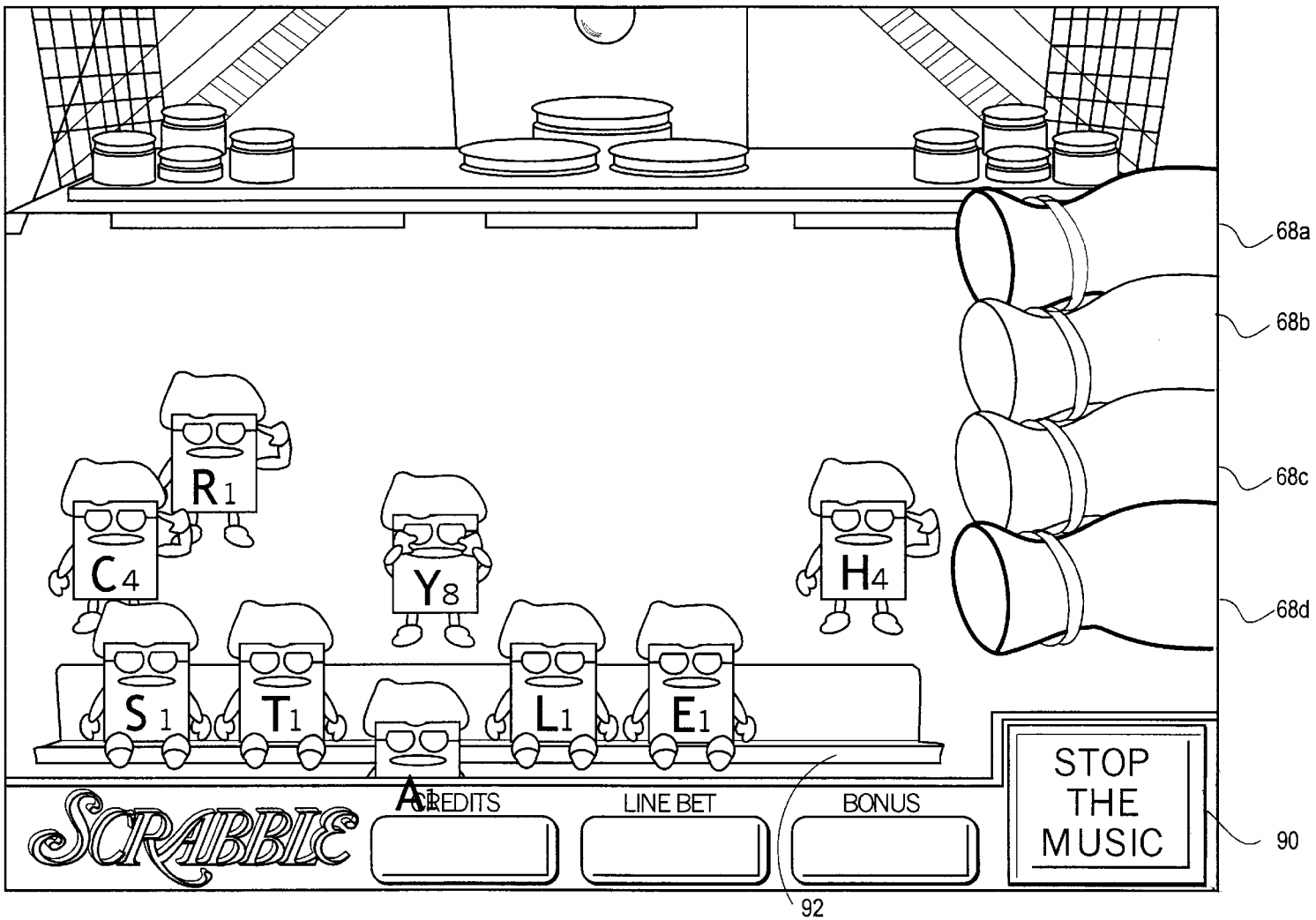
Figure 15:
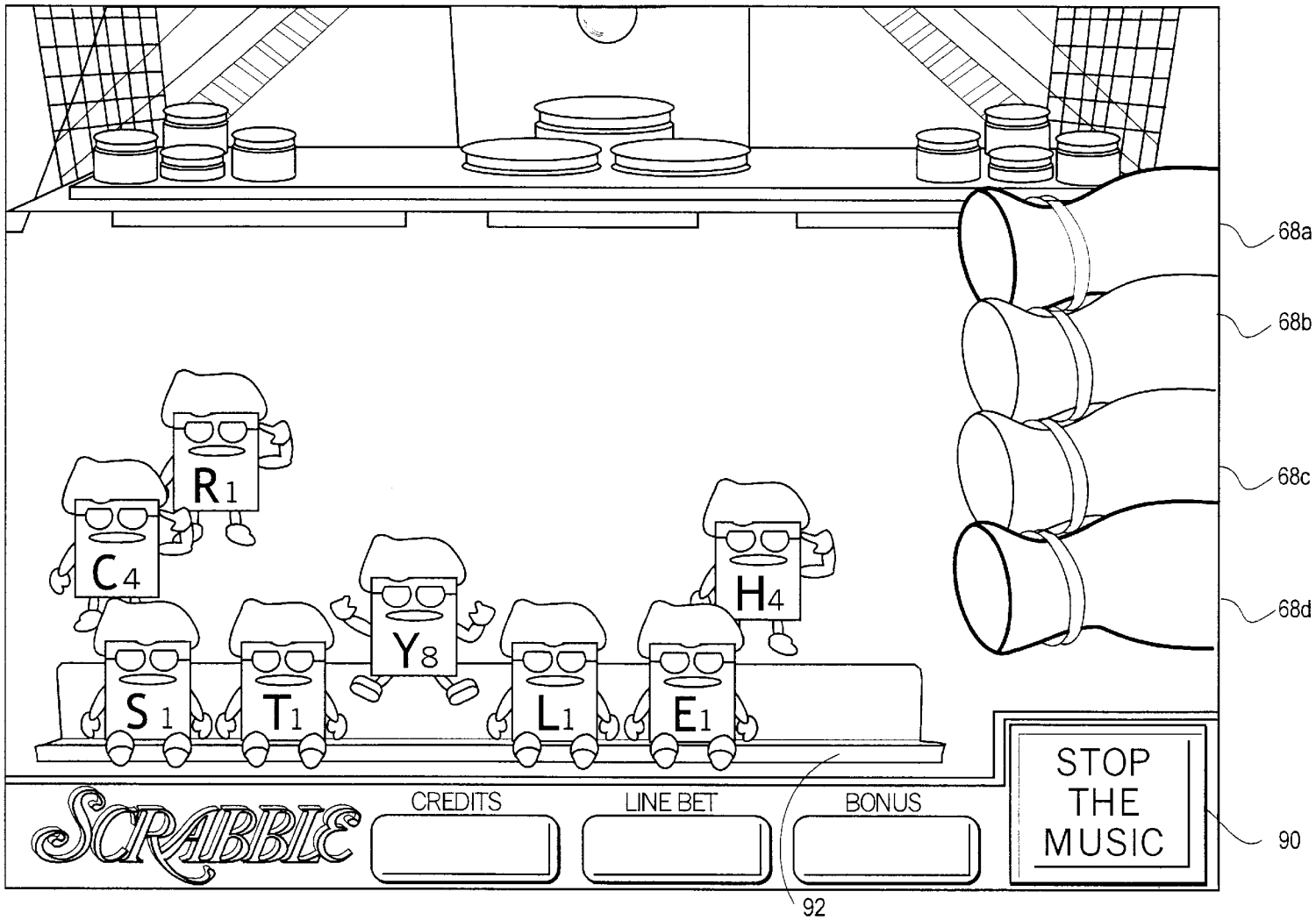
Figure 16:
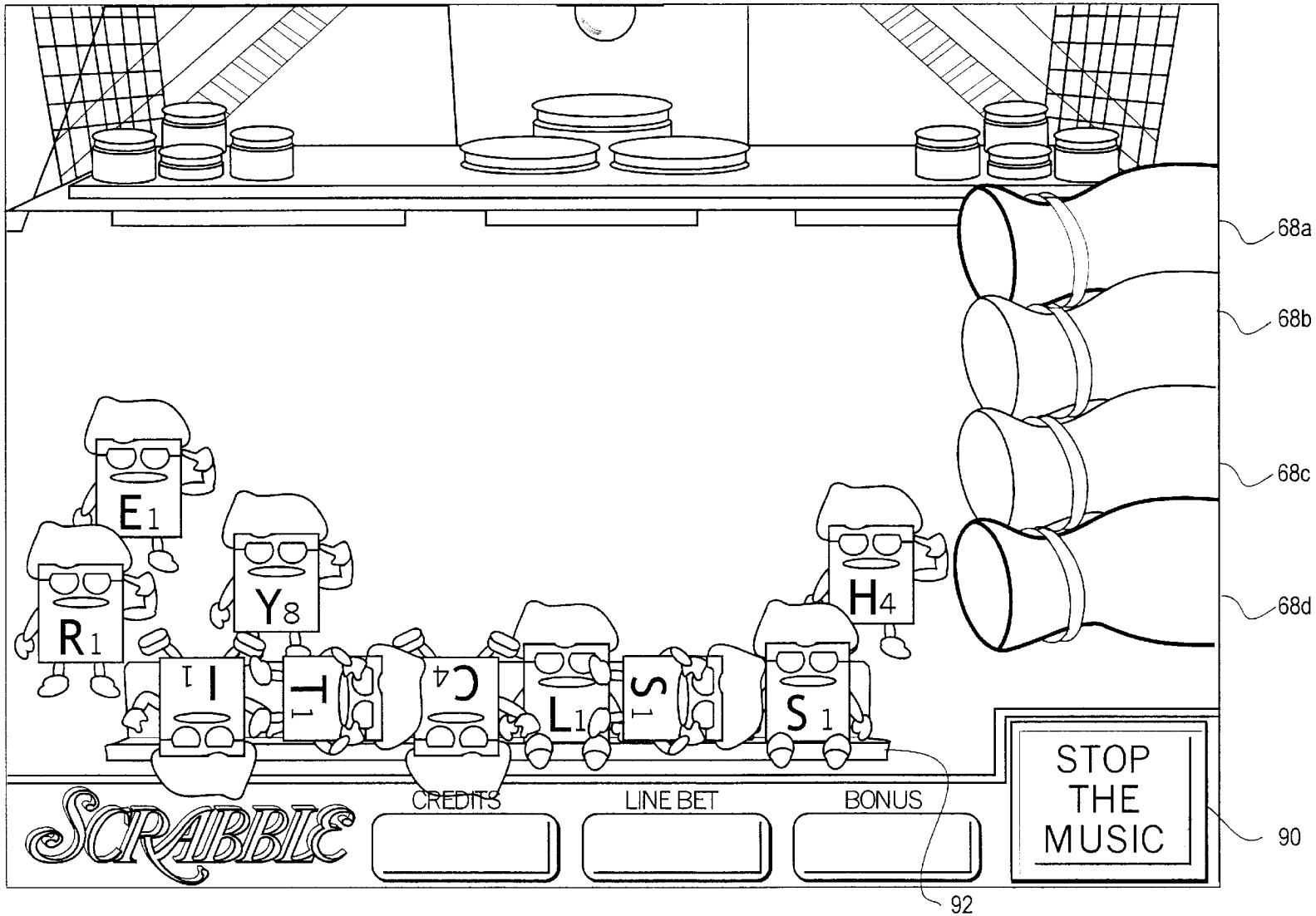

Referring to FIGS. 14, 15, and 16, the bag selection, word formation, and word placement steps are repeated until the letter tiles on the rack form a misspelled word. As shown in FIG. 16, some of the letter tiles in the misspelled word may be incorrectly oriented by 90 or 180 degrees. When the "Scrabble" bonus feature ends, the player is awarded the total bonus accumulated from all words on the puzzle board, and the CPU shifts operation back to the basic slot reel game.

While the present invention has been described with reference to one or more particular embodiments, those skilled in the art will recognize that many changes may be made thereto without departing from the spirit and scope of the present invention. For example, the puzzle board 94 in FIGS. 12 and 13 need not include a perfectly rectangular array of rows and columns, but rather could have any configuration of spaces that allows interlinking arrangements of puzzle elements. Also, the letter tiles may be replaced with other types of puzzle elements, such as symbols, pictures, shaped puzzle pieces, or playing cards, that can form arrangements of the puzzle elements and allow these arrangements to be interlinked. The arrangements when the puzzle elements are symbols could be unified images (i.e., pictures) formed by the adjacent symbols. The arrangements when the puzzle elements are playing cards could be poker hands such as a pair, two pair, three of a kind, straight, flush, full house, four of a kind, straight flush, royal flush. Each of these embodiments and obvious variations thereof is contemplated as falling within the spirit and scope of the claimed invention, which is set forth in the following claims.

What is claimed is:

1. A gaming machine, comprising:

a processor responding to a wager; and a puzzle game executed by the processor and displayed on one or more visual displays, the puzzle game having a plurality of possible outcomes and a plurality of arrangements of puzzle elements for generating respective payouts, at least one of the puzzle elements of each arrangement being shared by another one of the arrangements and contributing to the payouts generated by the respective arrangements that share the one of the puzzle elements, the puzzle elements being determined in response to random selection of at least one of the possible outcomes.

2. The gaming machine of claim 1, further including a basic game having a start-feature outcome, the puzzle game being triggered by the start-feature outcome of the basic game.

3. The gaming machine of claim 2, wherein the basic game includes a plurality of symbol-bearing rotatable reels that are spun and stopped to place at least one symbol on each reel in visual association with a viewable display area.

4. The gaming machine of claim 1, wherein the puzzle elements are selected from a group consisting of letters, symbols, pictures, shaped puzzle pieces, and playing cards.

5. The gaming machine of claim 1, wherein the arrangements are respective strings of letters of an alphabet.

6. The gaming machine of claim 5, wherein the arrangements form respective words.

7. The gaming machine of claim 6, wherein at least one of the letters of each word is shared by another one of the words and contributes to the payouts generated by the respective words that share the one of the letters.

8. The gaming machine of claim 1, wherein the payout generated by a respective one of the arrangements is based at least in part on values associated with the puzzle elements of the arrangement.

9. The gaming machine of claim 1, wherein the payout generated by a respective one of the arrangements is based at least in part on a sum of values associated with the puzzle elements of the arrangement.

10. The gaming machine of claim 1, wherein the puzzle game includes a gameboard displayed on the one or more visual displays, the gameboard including an array of locations, the arrangements being disposed on the gameboard with the puzzle elements in respective ones of the locations.

11. A gaming machine, comprising:

a processor responding to a wager; and a puzzle game executed by the processor and displayed on one or more visual displays, the puzzle game having a plurality of possible outcomes and interlocking arrangements of puzzle elements, at least one of the puzzle elements of each arrangement being shared by another one of the arrangements, each arrangement generating a respective payout based at least in part on the puzzle elements of the arrangement, the puzzle elements being determined in response to random selection of at least one of the possible outcomes.

12. A gaming machine controlled by a processor in response to a wager, comprising:

a primary gaming unit randomly selecting at least one of a plurality of possible primary outcomes, the plurality of possible primary outcomes including a start-feature outcome; and a secondary gaming unit triggered by the start-feature outcome and randomly selecting at least one of a plurality of possible secondary outcomes, the secondary gaming unit including indicia of a crossword puzzle game determined by the at least one of the possible secondary outcomes that has been randomly selected.

13. The gaming machine of claim 12, wherein the primary gaming unit includes a plurality of reels.

14. The gaming machine of claim 12, wherein the crossword puzzle game includes a plurality of letters with respective values and generates a payout based at least in part on the values of the letters.

15. A method of conducting a game of chance, comprising:

receiving a wager to activate a primary gaming unit;

operating the primary gaming unit to randomly select and display at least one of a plurality of possible primary outcomes, the plurality of possible primary outcomes including a start-feature outcome; and in response to the start-feature outcome, operating a secondary gaming unit to randomly select and display at least one of a plurality of possible secondary outcomes, the displayed secondary outcome including indicia of a crossword puzzle game.

16. The method of claim 15, wherein the primary gaming unit includes a plurality of reels.

17. The method of claim 15, further including generating a payout based upon the displayed secondary outcome.

18. A method of conducting a game of chance, comprising:

receiving a wager;

initiating a puzzle game having a plurality of possible outcomes;

randomly selecting at least one of the possible outcomes;

displaying interlocking arrangements of puzzle elements, at least one of the puzzle elements of each arrangement being shared by another one of the arrangements, the puzzle elements being determined by the at least one of the possible outcomes that has been randomly selected; and generating a respective payout based at least in part on the puzzle elements of the arrangement.

19. The method of claim 18, wherein the puzzle elements are selected from a group consisting of letters, symbols, pictures, shaped puzzle pieces, and playing cards.

20. The method of claim 19, wherein the arrangements are respective strings of letters of an alphabet.

21. The method of claim 20, wherein the arrangements form respective words.

* * * * *